US009239047B2

(12) United States Patent
Iwabuchi et al.

(10) Patent No.: US 9,239,047 B2
(45) Date of Patent: Jan. 19, 2016

(54) BELLOWS PUMP

(75) Inventors: Kyouhei Iwabuchi, Iruma-gun (JP); Hiroyuki Tanabe, Sayama-shi (JP); Toshiki Oniduka, Iruma-gun (JP); Atsushi Yoshida, Iruma-gun (JP)

(73) Assignee: IWAKI CO., LTD., Tokyo (JP)

( * ) Notice: Subject to any disclaimer, the term of this patent is extended or adjusted under 35 U.S.C. 154(b) by 186 days.

(21) Appl. No.: 14/005,683

(22) PCT Filed: Mar. 8, 2012

(86) PCT No.: PCT/JP2012/055955

§ 371 (c)(1),
(2), (4) Date: Sep. 17, 2013

(87) PCT Pub. No.: WO2012/132816

PCT Pub. Date: Oct. 4, 2012

(65) Prior Publication Data

US 2014/0010689 A1 Jan. 9, 2014

(30) Foreign Application Priority Data

Mar. 30, 2011 (JP) ..... 2011-076360

(51) Int. Cl.
*F04B 45/02* (2006.01)
*F04B 43/00* (2006.01)
(Continued)

(52) U.S. Cl.
CPC ..... *F04B 43/0009* (2013.01); *F04B 43/10* (2013.01); *F04B 43/1136* (2013.01); *F04B 45/022* (2013.01); *F04B 45/0336* (2013.01)

(58) Field of Classification Search
CPC ..... F04B 45/0336; F04B 45/022; F04B 43/0009; F04B 43/1136; F04B 43/10; F04B 45/033; F04B 45/02; F16J 3/048
USPC ..... 417/472, 473; 92/42
See application file for complete search history.

(56) References Cited

U.S. PATENT DOCUMENTS 582,139 A * 5/1897 Johnson ..... 92/39
1,178,638 A * 4/1916 Guest ..... 267/64.11
(Continued)

FOREIGN PATENT DOCUMENTS

CN 200972017 Y 11/2007
CN 101165348 A 4/2008
(Continued)

OTHER PUBLICATIONS

International Search Report issued in International Application No. PCT/JP2012/055955 dated May 22, 2012.
(Continued)

*Primary Examiner* — Bryan Lettman
(74) *Attorney, Agent, or Firm* — Oliff PLC

(57) ABSTRACT

A bellows pump with a case member that forms an axial space therein, closed-bottomed cylindrical bellows that are arranged in the space in an axially extendable/contractable manner and axially separate the space into a pump chamber and an operation chamber, suction valves that are provided on a suction side of the pump chamber and guide a fluid to be transferred to the pump chamber, and discharge valves that are provided on a discharge side of the pump chamber and discharge the fluid to be transferred from the pump chamber, and which extends/contracts the bellows by introducing a working fluid into the operation chamber to discharge the working fluid from the operation chamber, wherein each of the bellows is configured by alternately forming mountain portions and valley portions along the axial direction and having, on a predetermined position in the axial direction, annular ring portion integrally formed therewith.

4 Claims, 3 Drawing Sheets

(51) Int. Cl.

| | |
|---|---|
| ***F04B 43/10*** | (2006.01) |
| ***F04B 43/113*** | (2006.01) |
| ***F04B 45/033*** | (2006.01) |

(56) References Cited

U.S. PATENT DOCUMENTS

| | | | | | |
|---|---|---|---|---|---|
| 1,345,971 | A | * | 7/1920 | Star | 285/226 |
| 2,021,156 | A | * | 11/1935 | Smith | 417/472 |
| 2,056,106 | A | * | 9/1936 | Kuhn | 267/35 |
| 3,162,213 | A | * | 12/1964 | Peters | 138/30 |
| 3,381,361 | A | * | 5/1968 | Lecluse | B26D 3/16 29/423 |
| 3,411,452 | A | * | 11/1968 | Czarnecki et al. | 417/388 |
| 3,802,322 | A | * | 4/1974 | Johnson et al. | 92/39 |
| 4,488,473 | A | * | 12/1984 | Gammon | 91/50 |
| 5,141,412 | A | | 8/1992 | Meinz | |
| 2004/0188191 | A1 | * | 9/2004 | Lintner | F16D 55/22655 188/73.45 |
| 2006/0165541 | A1 | * | 7/2006 | Teshima | 417/472 |
| 2010/0119392 | A1 | * | 5/2010 | Masuda et al. | 417/472 |

FOREIGN PATENT DOCUMENTS

| | | | |
|---|---|---|---|
| DE | 671 148 | | 4/1940 |
| DE | 10 2009 011 067 | A1 | 9/2010 |
| EP | 2 166 228 | A1 | 3/2010 |
| JP | U-63-188372 | | 12/1988 |
| JP | U-02-132130 | | 11/1990 |
| JP | A-5-99153 | | 4/1993 |
| JP | A-2001-193836 | | 7/2001 |
| JP | A-2001-193837 | | 7/2001 |
| JP | U-3138916 | | 1/2008 |
| RU | 2 018 711 | C1 | 8/1994 |
| WO | WO 90/04106 | A1 | 4/1990 |

OTHER PUBLICATIONS

Extended European Search Report issued in Application No. 12764937.4 dated Oct. 21, 2014.

* cited by examiner

BELLOWS PUMP

TECHNICAL FIELD

The present invention relates to a bellows pump that performs a pump operation using bellows separating a pump chamber and an operation chamber.

BACKGROUND ART

A bellows pump has a structure in which a bellows divides an enclosed region into a pump chamber and an operation chamber. Then the bellows pump operates to compress and extend the pump chamber by introducing and discharging a working fluid into and from the operation chamber. Known examples of such a bellows pump are, for example, those disclosed in Patent Document 1 and Patent Document 2 listed below.

The bellows pumps disclosed in Patent Document 1 and Patent Document 2 have a configuration in which the bellows has an optimized shape to reduce a problem, such as deformation of a bellows 100 shown in FIG. 4 due to stress concentration caused by an operating pressure as shown by the arrows in FIG. 4. The bellows deformation arises if the pressure exceeds the limit of the bellows' pressure resistance performance or the temperature of the bellows increases too high. The problem has been addressed, therefore, by increasing the pressure resistance by changing the bellows shape as described above or increasing the bellows' wall thickness.

RELATED ART DOCUMENTS

Patent Documents

Patent Document 1: Examined Japanese Patent Application Publication No. JP 2001-193836 A Patent Document 2: Examined Japanese Patent Application Publication No. JP 2001-193837 A

SUMMARY OF THE INVENTION

Problem to be solved By the Invention

Unfortunately, increasing the pressure resistance performance by changing the bellows shape as described above or increasing the wall thickness will restrict the motion of the bellows itself or increase the operating resistance, thus adversely affecting the discharge amount of a fluid to be transferred. Then, more force is needed to expand and contract the bellows to eliminate the affect on the discharge amount, thereby reducing the operating efficiency.

The present invention was accomplished in light of the above problems. It is an object of the invention to provide a bellows pump having a bellows that has good temperature characteristics and that may improve the pressure resistance performance without decreasing the operating efficiency.

Means for solving the Problem

A first bellows pump according to the present invention comprises: a case member that forms an axial space therein; closed-bottomed cylindrical bellows that are arranged in the space in an axially extendable/contractable manner and axially separate the space into a pump chamber and an operation chamber; suction valves that are provided on a suction side of the pump chamber and guide a fluid to be transferred to the pump chamber; and discharge valves that are provided on a discharge side of the pump chamber and discharge the fluid to be transferred from the pump chamber, wherein the bellows are extended/contracted by introducing a working fluid into the operation chamber and discharging the working fluid from the operation chamber, thus transferring the fluid to be transferred, and wherein each of the bellows is configured by alternately forming mountain portions and valley portions along the axial direction, and having, on a predetermined position in the axial direction, an annular ring portion integrally formed therewith.

A second bellows pump according to the present invention comprises: a pump head; a pair of bottom-closed cylindrical bellows provided on respective opposite sides of the pump head with their opening sides being opposed, each bellows forming a pump chamber therein and being axially extendable/contractable; a pair of bottom-closed cylindrical cylinders attached to the pump head with their opening portions being opposed, the cylinders being disposed coaxially to the pair of bellows to contain the respective bellows therein, the cylinders forming operation chambers between the cylinders and the pair of bellows; a pair of pump shafts passing through the respective bottoms of the pair of cylinders slidably in an airtight manner along the central axis of the cylinders, the pump shafts having first ends joined to the respective bottoms of the pair of bellows; a joint shaft joining second ends of the pair of pump shafts movably in the axial direction; and a valve unit attached to the pump head in the pump chambers, the valve unit introducing a fluid to be transferred from a suction opening of the fluid to be transferred to the pump chamber and introducing the fluid to be transferred from the pump chamber to a discharge opening of the fluid to be transferred, the pair of bellows being extended/contracted by introducing a working fluid into the operation chamber and discharging the working fluid from the operation chamber, thus transferring the fluid to be transferred, and each of the pair of bellows being configured by alternately forming mountain portions and valley portions along the axial direction and having, on a predetermined position in the axial direction, an annular ring portion integrally formed therewith.

In one preferred embodiment, the ring portion is formed, for example, in a plurality at a predetermined interval in the axial direction.

In another embodiment, the bellows comprises, for example, fluororesin.

EFFECTS OF THE INVENTION

The present invention may provide a bellows pump having a bellows that has good temperature characteristics and that may improve the pressure resistance performance without decreasing the operating efficiency.

EMBODIMENTS FOR CARRYING OUT THE INVENTION

With reference to the accompanying drawings, the embodiments of a bellows pump according to the present invention will be described in more detail.

Figure 1:
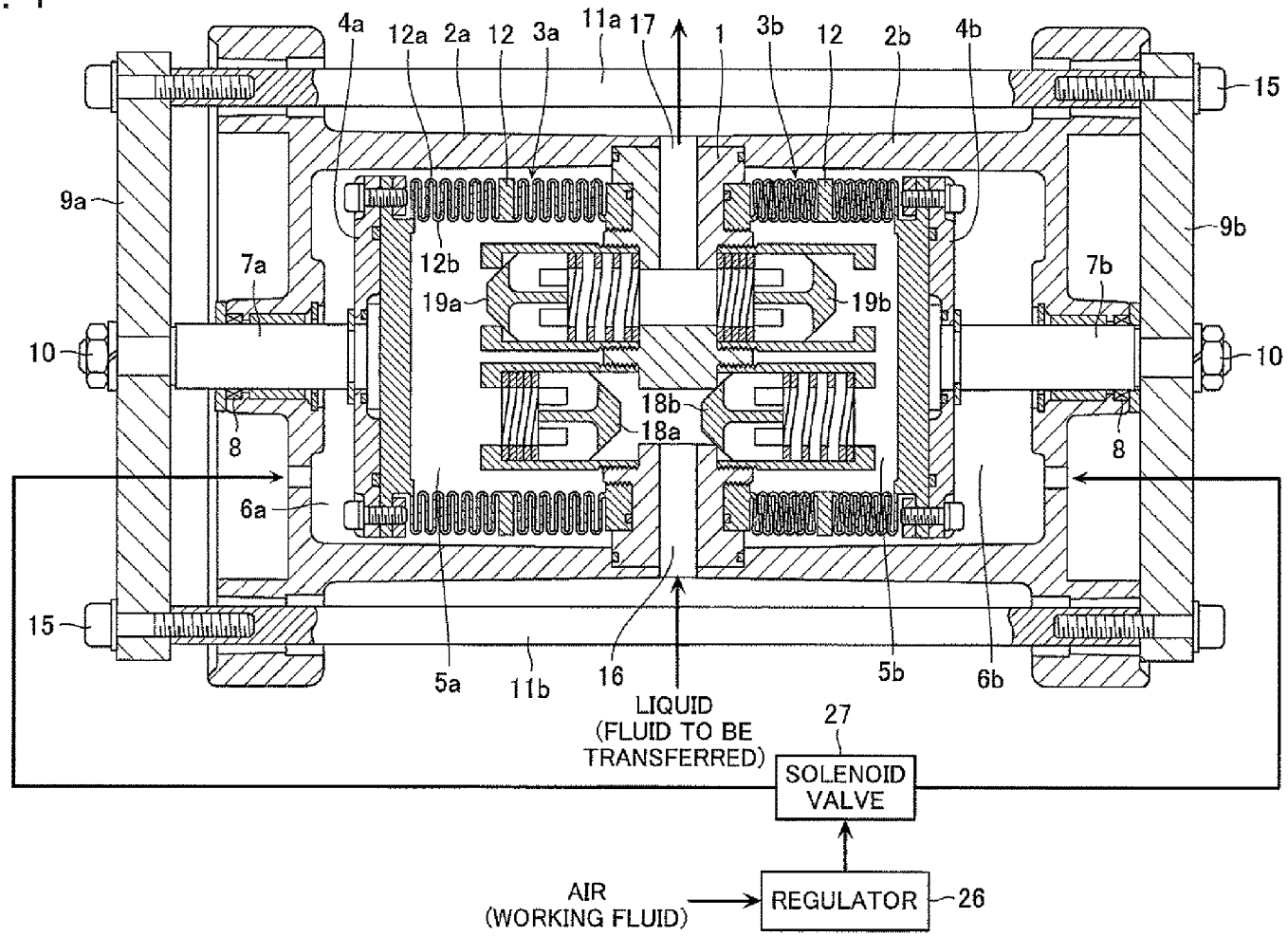
FIG. 1 is a cross-sectional view of a configuration of a bellows pump according to one embodiment of the present invention.

FIG. 1 is a cross-sectional view of a bellows pump according to one embodiment of the present invention and a schematic view of its peripheral mechanism. Note that although the bellows pump according to this embodiment will be described with respect to, by way of example, a bellows pump of a so-called multi-barrel type of a reciprocating pump structure, a bellows pump of a so-called single barrel type is also applicable.

The bellows pump is configured as follows. A pump head 1 is centrally disposed. Bottom-closed cylindrical cylinders 2*a* and 2*b*, which are case members, are coaxially disposed on the respective opposite sides of the pump head 1. The cylinders 2*a* and 2*b* comprise a pair of spaces formed therein. The spaces comprise respective bottom-closed cylindrical bellows 3*a* and 3*b* coaxially disposed therein.

The bellows 3*a* and 3*b* have opening ends secured to the pump head 1 and have respective shaft fixing plates 4*a* and 4*b* secured on their bottoms. The bellows 3*a* and 3*b* comprises, for example, fluororesin. The bellows 3*a* and 3*b* separate the inside spaces of the cylinders 2*a* and 2*b* into inside pump chambers 5*a* and 5*b* and outside operation chambers 6*a* and 6*b*, respectively.

Each of the bellows 3*a* and 3*b* has a structure that comprises mountain portions 12*a* and valley portions 12*b*, which are alternately formed in the axial direction, and an annular ring portion 12 integrally formed around an intermediate position in the axial direction. The bellows 3*a* and 3*b* have the same shape as a usual bellows without the ring portion 12. The number of mountain portions 12*a* and valley portions 12*b* are set to provide the same wall thickness and the same operating resistance as a usual bellows.

Shafts 7*a* and 7*b* extending coaxially have first ends secured to the respective shaft fixing plates 4*a* and 4*b*. The shafts 7*a* and 7*b* have second ends passing through the bottom centers of the cylinders 2*a* and 2*b* in an airtight manner via seal members 8 to the outside of the cylinders 2*a* and 2*b*, respectively. Joint plates 9*a* and 9*b* are secured to the second ends of the shafts 7*a* and 7*b* via nuts 10.

The joint plates 9*a* and 9*b* are joined together by joint shafts 11*a* and 11*b* at positions above and below the cylinders 2*a* and 2*b*. Each of the joint shafts 11*a* and 11*b* is secured to the joint plates 9*a* and 9*b* via bolts 15.

The pump head 1 comprises a suction opening 16 and a discharge opening 17 for a fluid to be transferred, the openings 16 and 17 being at positions facing the side surfaces of the pump. In addition, the pump head 1 comprises suction valves 18*a* and 18*b* at positions in a path from the suction opening 16 to the pump chambers 5*a* and 5*b*, and discharge valves 19*a* and 19*b* at positions in a path from the pump chambers 5*a* and 5*b* to the discharge opening 17.

Meanwhile, a working fluid such as an air from a working fluid source such as a not-shown air compressor is regulated to a predetermined pressure by a regulator 26 and supplied to a solenoid valve 27.

It is assumed here that the operation chamber 6*a* is in an exhaust state, the operation chamber 6*b* is in an air-introducing state, the pump chamber 5*a* is in an expansion process, and the pump chamber 5*b* is in a contracting process. Then, the suction valve 18*a* and the discharge valve 19*b* are in an open state and the suction valve 18*b* and the discharge valve 19*a* are in a closed state. The liquid to be transferred is thus introduced from the suction opening 16 to the pump chamber 5*a* and discharged from the pump chamber 5*b* via the discharge opening 17.

The bellows 3*a* and 3*b* repeat the expansion and contraction in the axial direction to achieve the operation by the expansion and contraction of the pump chambers 5*a* and 5*b* as described above. Then, even if the transfer pressure or the operating pressure is increased to transfer more fluid to be transferred or the temperature inside the pump increases during the operation, the ring portion 12 may provide high pressure resistance without using a large wall thickness, thus preventing the deformation or damage. In other words, each of the bellows 3*a* and 3*b* has a structure that may provide higher pressure resistance than a bellows without the ring portion 12 if they are set to have the same operating efficiency as the bellows without the ring portion 12.

Therefore, the bellows pump according to this embodiment may have better temperature characteristics and higher pressure resistance performance without reducing the operating efficiency than a conventional bellows pump comprising a bellows without the ring portion 12. Note that the bellows 3*a* and 3*b* may be configured as follows.

Figure 2:
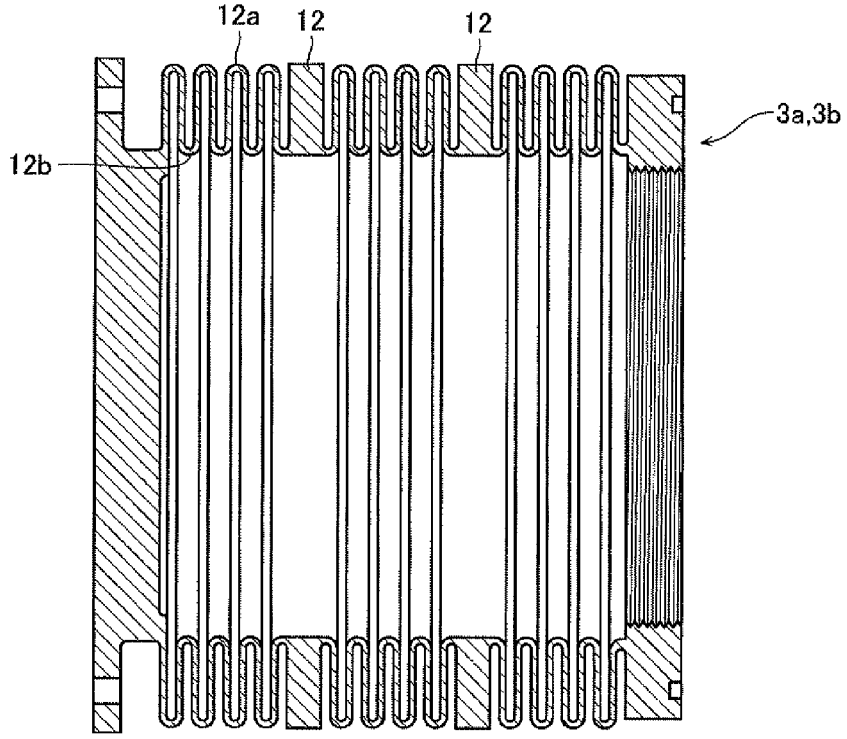
FIG. 2 shows another example of the bellows of the bellows pump.
Figure 3:
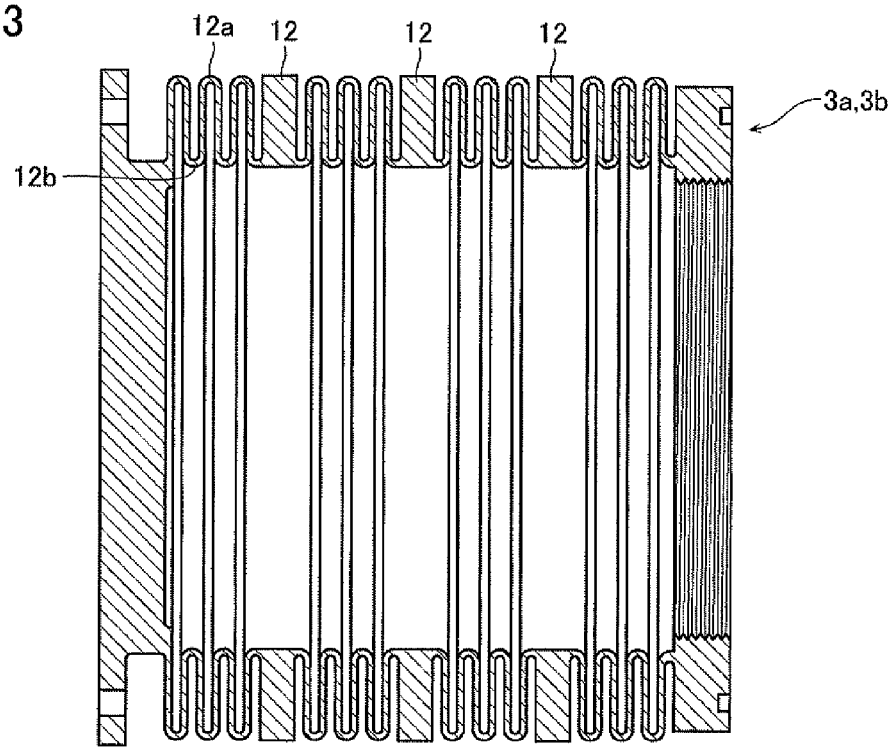
FIG. 3 shows still another example of the bellows of the bellows pump.

FIG. 2 shows another example of the bellows 3*a* and 3*b* of the bellows pump. FIG. 3 shows still another example of the bellows 3*a* and 3*b* of the bellows pump. With reference to FIG. 2 and FIG. 3, each of the bellows 3*a* and 3*b* comprises the mountain portions 12*a* and the valley portion 12*b* as well as two or three ring portions 12 formed at a predetermined interval in the axial direction, for example. In this way, the bellows 3*a* and 3*b* comprising a plurality of ring portions 12 may also improve the pressure resistance as in FIG. 1. Note that the ring portions 12 are not necessarily provided at regular intervals.

EXAMPLES

The applicants performed the following burst test and operating resistance test to check the characteristics of the above bellows 3*a* and 3*b*. In these tests, all the bellows were made of fluororesin and had a wall thickness of 2 mm and 12 mountain portions 12*a*. In addition, the ring portion 12 had an axial direction thickness of 10 mm. The example 1 is for one ring portion 12, the example 2 is for two ring portions 12, the example 3 is for three ring portions 12, and the comparative example is for zero ring portion 12.

Figure 4:
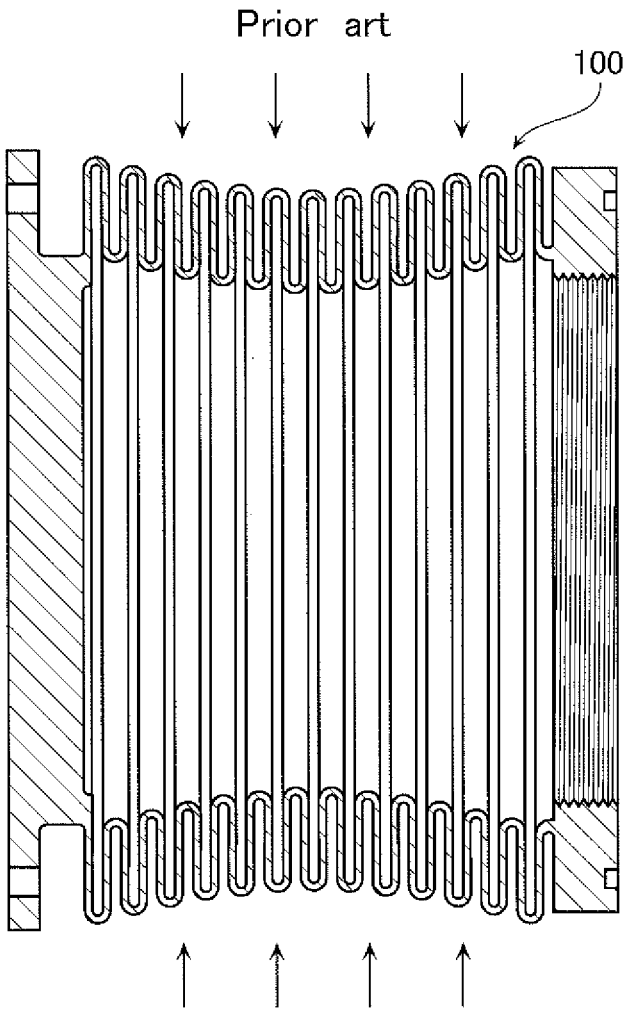
FIG. 4 shows problems of the bellows of conventional bellows pumps.

With reference to FIG. 4, the burst test was performed by applying external pressure to the bellows, and the operating resistance test was performed by pulling the bellows in the axial direction with a predetermined load. Table 1 below shows the burst test results. Table 2 below shows the operating resistance test results. Note that in the burst test, the temperature (ambient temperature) of the bellows was set to 180° C.

TABLE 1

| BELLOWS AMBIENT TEMPERATURE (° C.) | BELLOWS BURST PRESSURE (MPa) | | | |
|---|---|---|---|---|
| | COMPARATIVE EXAMPLE | EXAMPLE 1 | EXAMPLE 2 | EXAMPLE 3 |
| 180° C. | 0.286 | 0.298 | 0.389 | 0.376 |

TABLE 2

UNIT (mm)

| | COMPARATIVE EXAMPLE | EXAMPLE 1 | EXAMPLE 2 | EXAMPLE 3 |
|---|---|---|---|---|
| FREE LENGTH | 175.5 | 187.4 | 199 | 212.7 |
| LENGTH UNDER LOAD OF 10 kgf | 181.3 | 193.6 | 205 | 219 |
| ELONGATION | 5.8 | 6.2 | 6.0 | 6.3 |

Table 1 shows that in the burst test, the bellows burst pressure (MPa) was 0.286 in the comparative example, while 0.298 in the example 1, 0.389 in the example 2, and 0.376 in the example 3, which all exceed the result in the comparative example. This proves that the pressure resistance is improved.

Meanwhile, table 2 shows that in the operating resistance test, the axial free length of the bellows was 175.5 mm in the comparative example, while 187.4 mm in the example 1, 199 mm in the example 2, and 212.7 mm in the example 3. In addition, the length under a load of 10 kgf was 181.3 mm in the comparative example, while 193.6 mm in the example 1, 205 mm in the example 2, and 219 mm in the example 3.

Therefore, the elongation of the bellows was 5.8 mm in the comparative example, while 6.2 mm in the example 1, 6 mm in the example 2, and 6.3 mm in the example 3. This result shows almost the same operating resistance in the comparative example and the examples 1, 2, and 3. This proves that the operating resistance remains unchanged regardless of the presence or absence of the ring portion 12.

As described above, in the bellows pump according to the present invention, the bellows 3*a* and 3*b* comprising the ring portion 12 may have good temperature characteristics and improve the pressure resistance performance without decreasing the operating efficiency.

DESCRIPTION OF REFERENCE NUMERALS

1 pump head
2*a*,2*b* cylinder
3*a*,3*b* bellows
4*a*,4*b* shaft fixing plate
5*a*,5*b* pump chamber
6*a*,6*b* operation chamber
7*a*,7*b* shaft
9*a*,9*b* joint plate
11*a*,11*b* joint shaft
12 ring portion
12*a* mountain portion
12*b* valley portion
16 suction opening
17 discharge opening
18*a*,18*b* suction valve
19*a*,19*b* discharge valve
26 regulator
27 solenoid valve

The invention claimed is:

1. A bellows pump comprising:

a case member that forms an axial space therein;

closed-bottomed cylindrical bellows that are arranged in the axial space to extend and contract in an axial direction and axially separate the axial space into a pump chamber and an operation chamber;

suction valves that are provided on a suction side of the pump chamber and guide a fluid to be transferred to the pump chamber; and discharge valves that are provided on a discharge side of the pump chamber and discharge the fluid to be transferred from the pump chamber, wherein the bellows are extended and contracted by introducing a working fluid into the operation chamber and discharging the working fluid from the operation chamber, thus transferring the fluid to be transferred, each of the bellows is configured by alternately forming mountain portions and valley portions along the axial direction and having, on a predetermined position in the axial direction where a valley portion is formed, an annular ring portion extending in a radial direction from the valley portion to a mountain portion, the radial direction being perpendicular to the axial direction, each of the bellows further including at least one additional annular ring portion, the at least one additional annular ring portion extending in the radial direction from another valley portion to another mountain portion and being formed at a predetermined interval relative to the annular ring portion in the axial direction, and each of the annular ring portion and the at least one additional annular ring portion being integrally formed as a single piece with the valley portions and the mountain portions of the bellows.

2. The bellows pump according to claim 1, wherein the bellows comprises fluororesin.

3. A bellows pump comprising:

a pump head;

a pair of bottom-closed cylindrical bellows provided on respective opposite sides of the pump head with opening sides of the pair of bellows being opposed to one another, each of the pair of bellows forming a pump chamber therein to extend and contract in an axial direction;

a pair of bottom-closed cylinders attached to the pump head with opening portions of the cylinders being opposed to one another, the pair of cylinders being disposed coaxially to the pair of bellows to contain the respective bellows therein, the pair of cylinders forming operation chambers between the pair of cylinders and the pair of bellows;

a pair of pump shafts passing through respective bottoms of the pair of cylinders slidably in an airtight manner along a central axis of the pair of cylinders, the pair of pump shafts having first ends joined to respective bottoms of the pair of bellows;

a joint shaft joining second ends of the pair of pump shafts movably in the axial direction; and a valve unit attached to the pump head in the pump chambers, the valve unit introducing a fluid to be transferred from a suction opening of the fluid to be transferred to the pump chamber and introducing the fluid to be transferred from the pump chamber to a discharge opening of the fluid to be transferred, wherein the pair of bellows is extended and contracted by introducing a working fluid into the operation chambers and discharging the working fluid from the operation chambers, thus transferring the fluid to be transferred, each of the pair of bellows is configured by alternately forming mountain portions and valley portions along the axial direction and having, on a predetermined position in the axial direction where a valley portion is formed, an annular ring portion extending in a radial direction from the valley portion to a mountain portion, the radial direction being perpendicular to the axial direction, each of the bellows further including at least one additional annular ring portion, the at least one additional annular ring portion extending in the radial direction from another valley portion to another mountain portion and being formed at a predetermined interval relative to the annular ring portion in the axial direction, and each of the annular ring portion and the at least one additional annular ring portion being integrally formed as a single piece with the valley portions and the mountain portions of the bellows.

4. The bellows pump according to claim 3, wherein the bellows comprises fluororesin.

* * * * *